US005757254A

United States Patent [19]

Kurono et al.

[11] Patent Number: 5,757,254

[45] Date of Patent: May 26, 1998

[54] EARTH LEAKAGE BREAKER

[75] Inventors: Toru Kurono, Seto; Masakazu Saida, Nagoya; Shigehira Konishi, Nisshin, all of Japan

[73] Assignee: Nitto Electric Works, Ltd., Aichi-ken, Japan

[21] Appl. No.: 732,608

[22] Filed: Oct. 16, 1996

[30] Foreign Application Priority Data

Nov. 1, 1995 [JP] Japan ..... 7-285049

[51] Int. Cl.[6] ..... H01H 75/12

[52] U.S. Cl. ..... 335/35; 335/169; 335/172

[58] Field of Search ..... 335/23, 24, 25, 335/35, 176, 167–175

[56] References Cited

U.S. PATENT DOCUMENTS 2,895,028 7/1959 Ellenberger ..... 335/35

3,938,065 2/1976 Ellenberger ..... 335/24

4,529,951 7/1985 Youichi et al. ..... 335/13

*Primary Examiner*—Michael L. Gellner

*Assistant Examiner*—Raymond Barrera

*Attorney, Agent, or Firm*—Frishauf, Holtz, Goodman, Langer & Chick

[57] ABSTRACT

An earth leakage breaker has a case, a handle protruding from the case, a cradle for determining stable positions of the handle, and a movable finger including a movable contact at a bottom portion of the movable finger. The movable finger is pivotally jointed to the handle at a protrusion provided on a lower side of the handle. An extension spring spans between the cradle and the movable finger, and a top-end swinging trigger plate is provided for engaging the cradle. The trigger plate has a fulcrum at a bottom portion thereof, and a test button and a leak trip solenoid are adjacently arranged at a top portion of the case, with the leak trip solenoid having a trip piece engaged with a contact portion formed on a top portion of the trigger plate for effecting circuit breaking due to a leak.

5 Claims, 4 Drawing Sheets

EARTH LEAKAGE BREAKER

BACKGROUND OF THE INVENTION

1. Field of the Invention

The present invention relates to an earth leakage breaker provided with a trip device at a leak detecting section.

2. Description of the Related Art

An earth leakage breaker is constituted by additionally incorporating a leak detecting section into a circuit breaker. Moreover, it has a function for breaking the circuit not only when overcurrent flows but also when a leak is detected. This type of earth leakage breaker is generally provided with a test button for testing whether the leak detecting section operates normally. Moreover, the test button is set to the top of a case so as to be easily used.

FIG. 3A shows a conventional earth leakage breaker in which test button 36 of the leak detecting section is set to the top of a case. In FIG. 3A, symbol 31 denotes an overcurrent detecting bimetal and 32 denotes a trigger plate. Moreover, symbol 33 denotes a ZCT (Zero-phase Current Transformer) for detecting a leak and 34 denotes a printed circuit board of the leak detecting section, and 35 denotes a leak trip solenoid for breaking a circuit by pulling the bottom end of trigger plate 32 because current flows when ZCT 33 detects a leak and operating a trip mechanism. Leak trip solenoid 35 operates because current flows also when test button 36 set to the top of the case is pressed. Thereby, it is possible to test whether the leak detecting section normally operates.

However, this type of the conventional earth leakage breaker has a problem in that the structure is complicated and it is not easy to assemble the breaker because test button 36 is set to the top of the case and leak trip solenoid 35 is set to the bottom of bimetal 31 separately from the button. Moreover, because ZCT 33 and printed circuit board 34 are present at the back of bimetal 31, adjusting screw 37 for adjusting I-t characteristic of bimetal 31 is located at the central portion of the case. Therefore, problems occur in that no part can be arranged at a portion through which a tool passes and moreover, the breaker is increased in size because test button 36 and leak trip solenoid 35 are separately arranged. Furthermore, problems occur in that it is difficult to turn adjusting screw 37 from the outside and it is difficult to lock adjusting screw 37 after adjustment.

SUMMARY OF THE INVENTION

Problems to Be Solved by the Invention

It is an object of the present invention to solve the above conventional problems and achieve at least one of downsizing a breaker, realizing a structure capable of adjacently arranging a test button and a leak trip solenoid, and easily manipulating a bimetal adjusting screw from the outside.

Means for Solving the Problems

The present invention made to solve the above problems is an earth leakage breaker comprising cradle 6 for determining stable positions of a handle 21 and a movable finger provided with a movable contact C at the bottom by securely fitting the movable finger 22 to the lower side of the handle and engaging the front end 6*a* to trigger plate 7 and toggle-type mechanism provided with extension spring 20 between the mechanism and the movable contact; in which test button 18 and leak trip solenoid 15 are adjacently arranged at the top of a case, trigger plate 7 is a top-end-swinging type having a fulcrum 11 at its lower portion, trip piece 13 of leak trip solenoid 15 is engaged with the contact portion 14 formed on the top end of the trigger plate 7, and, if necessary, bimetal adjusting screw 10 is set to the bottom of the case.

BRIEF DESCRIPTION OF THE DRAWINGS

FIGS. 2A to 2D are illustrations showing the shape of a trigger plate of an earth leakage breaker of the present invention, in which FIG. 2A is a perspective view showing the relation with relevant parts, FIG. 2B is a left side view, FIG. 2C is a front view, and FIG. 2D is a right side view;

FIGS. 3A to 3E are illustrations showing a conventional earth leakage breaker, in which FIG. 3A is a sectional view, FIG. 3B is a left side view of a conventional trigger plate, FIG. 3C is a front view, FIG. 3D is a right side view, and FIG. 3E is a top view.

DETAILED DESCRIPTION OF THE PREFERRED EMBODIMENT

Figure 1:
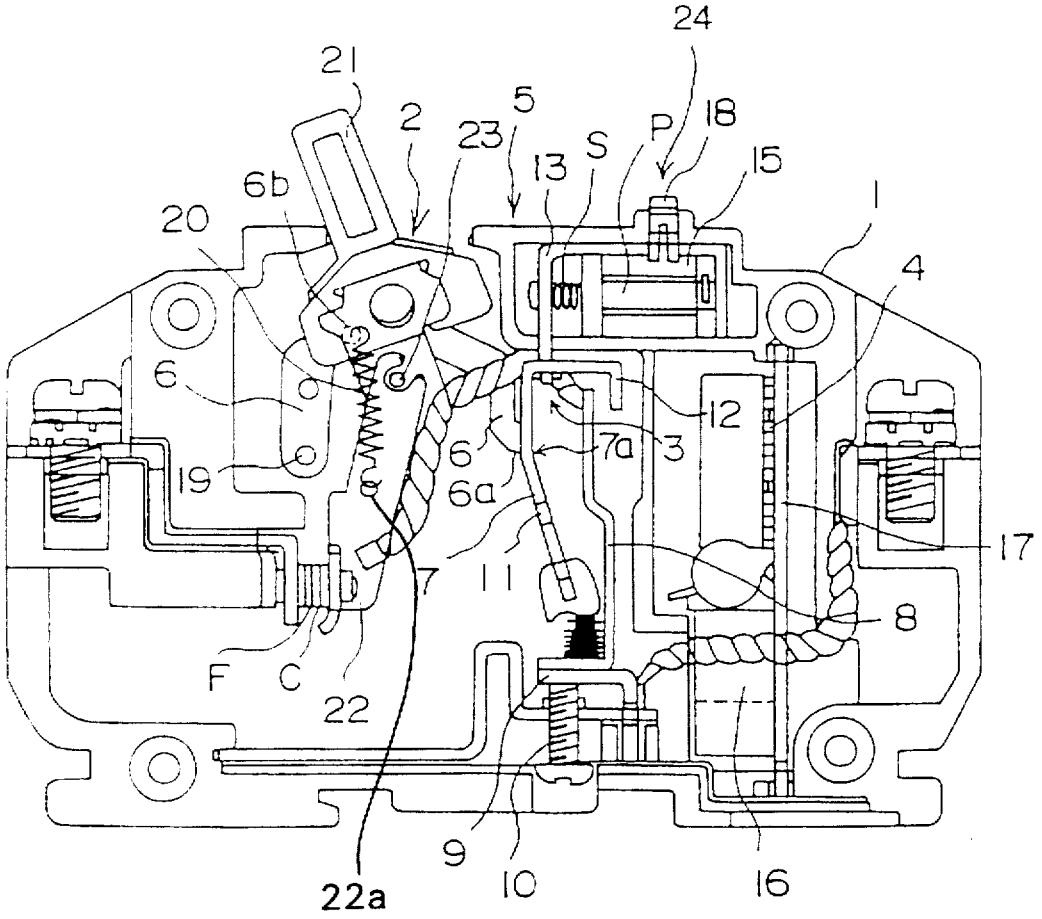
FIG. 1 is a sectional view of an earth leakage breaker of the present invention.
Figure 2A:
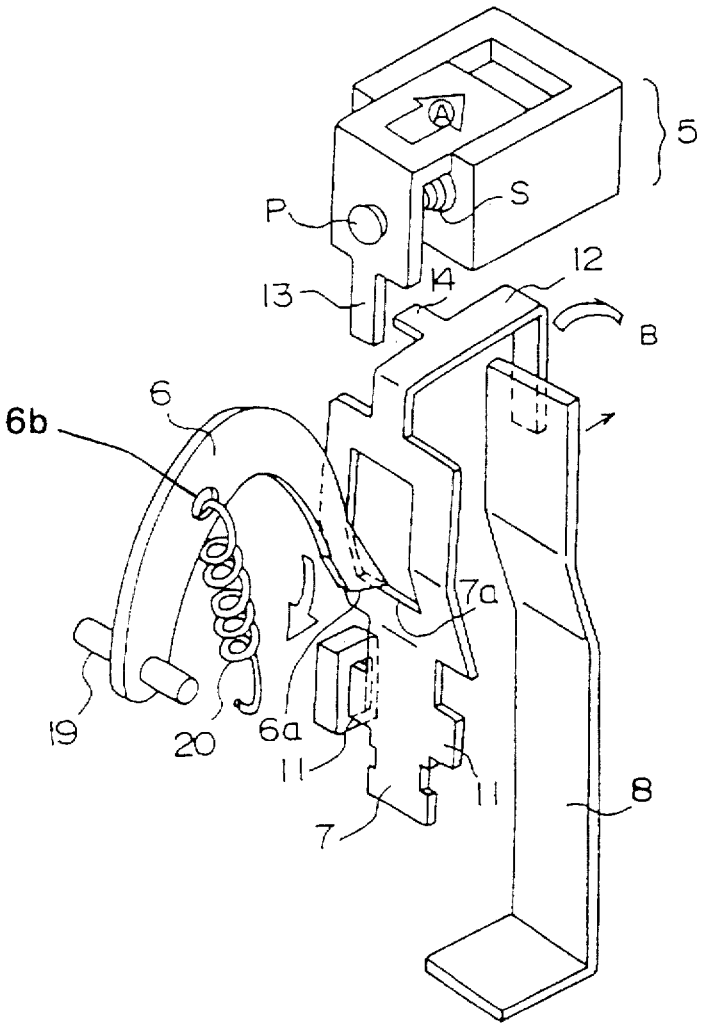
Figure 2B:
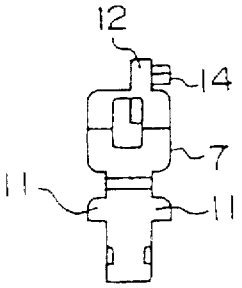
Figure 2C:
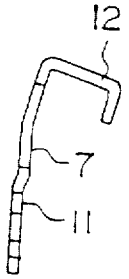
Figure 2D:
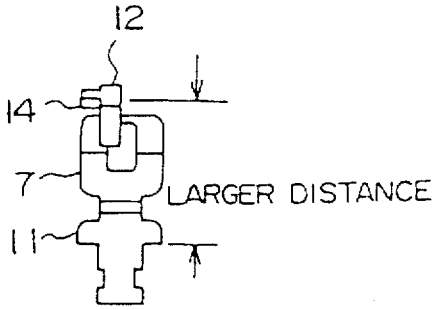
Figure 3A:
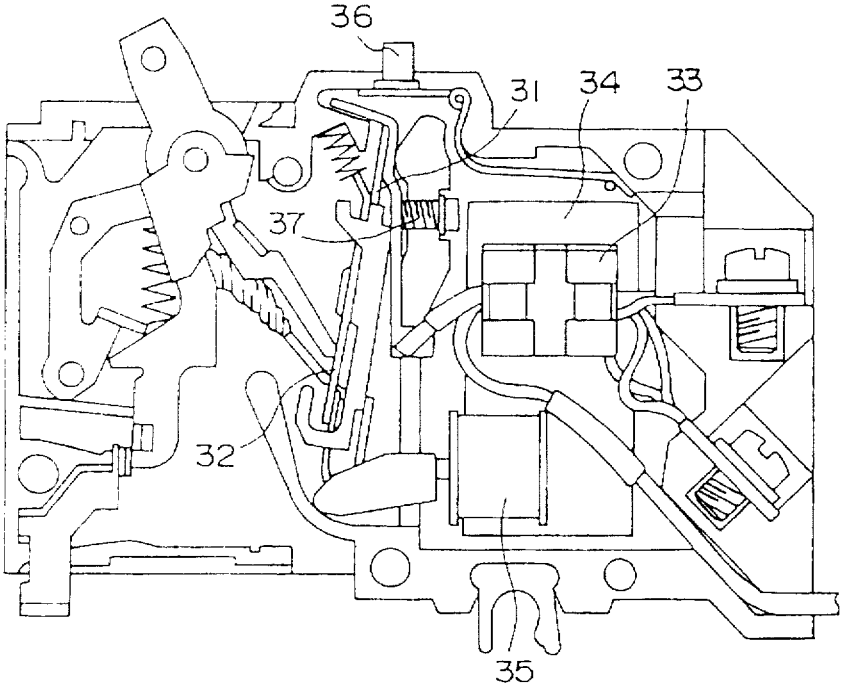
Fig. 3A (Prior Art)
Figure 3E:
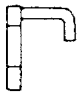
Fig. 3E (Prior Art)
Figure 3B:
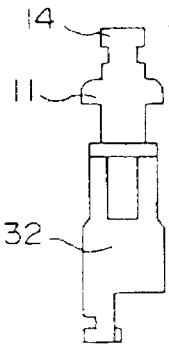
Fig. 3B (Prior Art)
Figure 3C:
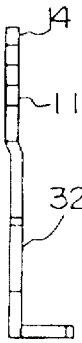
Fig. 3C (Prior Art)
Figure 3D:
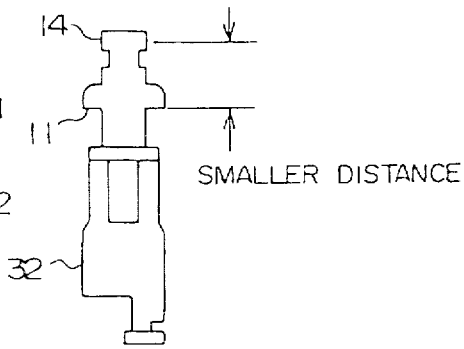
Fig. 3D (Prior Art)

In FIG. 1, symbol 1 denotes a case, 2 denotes a mechanical section, 3 denotes a trip section, 4 denotes a leak detecting section, 5 denotes a trip device provided for the top of case 1, and 24 denotes a test device. Trip section 3 comprises trigger plate 7 for supporting an end 6*a* of cradle 6 and bimetal 8 to be curved due to overcurrent.

Bimetal 8, unlike a conventional bimetal, is vertically set on reverse-L-type elastic support piece 9 set to the bottom of case 1. Then, by pressing the bottom of elastic support piece 9 by the top end of adjusting screw 10 set to the bottom of case 1, the position and angle of bimetal 8 are adjusted and the I-t characteristic of bimetal 8 is adjusted. Moreover, trigger plate 7 is a top-end-swinging type having fulcrum 11 at the lower portion differently from a conventional one. FIGS. 2A to 2D are illustrations showing the shape of trigger plate 7, in which fulcrum 11 is set to a portion lower than the center in the vertical direction and bent portion 12 at the top end is engaged with the top end of bimetal 8. Moreover, contact portion 14 with trip piece 13 of trip device 5 is formed at the lateral of bent portion 12.

As described above, the breaker mechanism of the present invention is provided with cradle 6 comprising a "Λ"-shaped plate for determining stable positions of handle 21 and movable finger 22 having movable contact C at the bottom by securely fitting movable finger 22 to protrusion 23 protruded to the lower side of handle 21. Cradle 6 is pivotally mounted at the base end located at the left side in FIG. 1 to case 1 by pin 19 and makes the crest portion at the center of the "Λ" shape locate between forks at the bottom of handle 21, and moreover engages the right end 6*a* to securing hole 7*a* of trigger plate 7. Moreover, extension spring 20 is set between a securing hole 6*b* formed at the center of the crest portion of cradle 6 and a securing hole 22*a* in in the central portion of movable finger 22 (refer to FIG. 1 and FIG. 2). By turning on/off handle 21 while the front end 6*a* of cradle 6 engages with securing hole 7*a* of trigger plate 7, the movable finger 22 operates to perform opening or closing. If the top end of trigger plate 7 is pressed rightward, trigger plate 7 swings about fulcrum 11 and the right end 6*a* of cradle 6 is removed from the securing hole 7*a* of trigger plate 7. In this case, cradle 6 rotates about pin 19 clockwise on the drawing, rotates handle 21 up to the trip position by the force of extension spring 20, and operates movable finger 22 to break the circuit. The advantage of using the top-end-swinging type trigger plate 7 is described later.

Leak detecting section 4 comprises ZCT 16 for detecting a leak, printed circuit board 17 of the leak detecting section for amplifying a detected signal, leak trip solenoid 15 for performing trip by the amplified signal, and a test device 24 for testing whether the above mechanism correctly operates when an actual leak occurs.

Trip device 5 comprises solenoid coil 15 for attracting a plunger P, a base for fixing the solenoid coil 15, a trip piece 13 engaged with plunger P, and spring S for normally pressing trip piece 13 toward the left side in FIG. 1.

ZCT 16 comprises an iron core and a secondary winding wound on an iron core, in which the iron core vector-synthesizes magnetic fluxes generated due to the current of each phase of a primary conductor for flowing a main-circuit current by passing through the center of ZCT 16 and an electromotive force is generated in the secondary winding due to a magnetic flux corresponding to the difference between the phases. Therefore, if the synthesized current vector of phases is zero independently of the intensity of primary current, no electromotive force is generated in the secondary winding because the fluxes offset each other in the iron core. However, if a problem such as a leak occurs, the current balance between phases is lost, the iron core is excited due to a flux corresponding to the intensity of leak current, and an electromotive force is generated in the secondary winding.

When a leak actually occurs, an electromotive force generated in ZCT 16 is amplified by printed circuit board 17 to excite solenoid coil 15 and attract plunger P. Therefore, trip piece 13 engaged with plunger P moves to the coil side against the force of spring S to move contact portion 14 of trigger plate 7 rightward.

Figure 4:
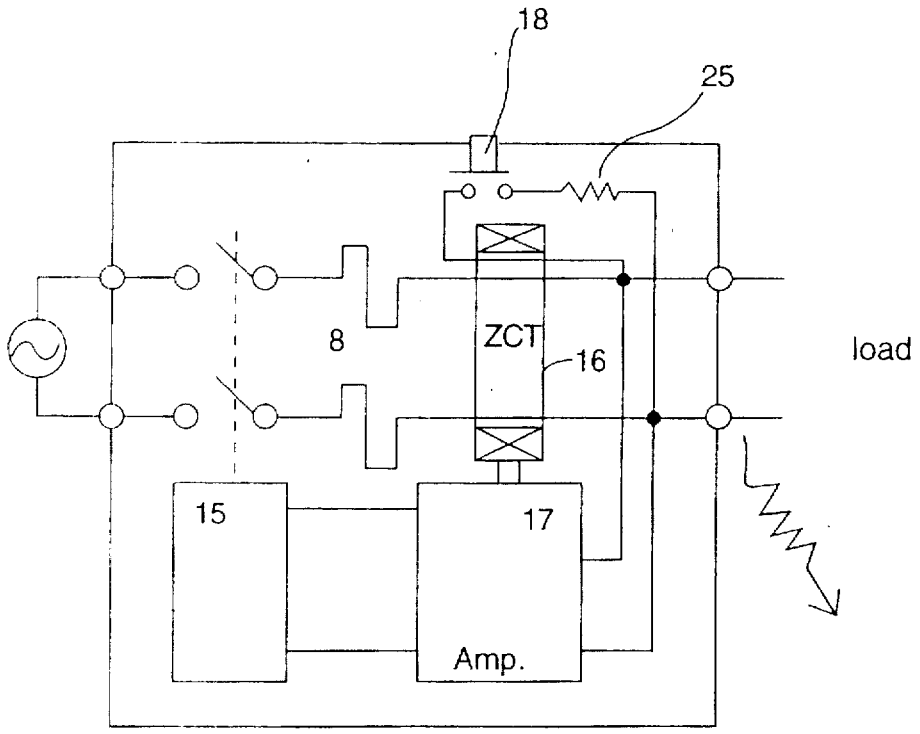
FIG. 4 is an illustration showing an electrical circuit including a ZCT.

The test device 24 comprises test button 18 and test resistance 25, which is a circuit connected as shown in FIG. 4 and artificially causes a short circuit by pressing the test button under the condition, the contacts are closed. That is, by pressing test button 18, an unbalanced current flows through a primary conductor of the ZCT, and the breaker trips to be turned off as the leak actually occurs. Thus, leak trip solenoid 15 of trip device 5 operates not only when ZCT 16 detects a leak but also when a test is performed.

An earth leakage breaker of the present invention thus constituted has the following advantages. First, because trip device 5 constituted by adjacently arranging test button 18 and leak trip solenoid 15 at the top of case 1, it is possible to easily test leak detecting section 4. Moreover, the breaker can easily be assembled because it is unnecessary to separately arrange a test button 18 and a leak trip solenoid 15.like a conventional one.

Second, because the earth leakage breaker of the present invention does not require a special tool for adjustment and it is very easily adjusted when it is shipped from a factory because adjusting screw 10 of bimetal 8 is set to the bottom of case 1. Moreover, screws can easily be locked after adjustment and adjusting screw 10 is not erroneously turned because it is located at the bottom of case 1 which is not touched by any one. Furthermore, it is unnecessary to form a notch through which a tool is inserted on printed circuit board 17 of leak detecting section 4.

Furthermore, because trigger plate 7 of an earth leakage breaker of the present invention is the top-end-swinging type having fulcrum 11 at the bottom of the trigger plate 7 and contact portion 14 with trip piece 13 of trip device 5 is formed at the top end of trigger plate 7, it is possible to decrease the trip load of trip device 5 though trip device 5 is set to the top of case 1. That is, if trigger plate 7 is the conventional bottom-end-swinging type and trip device 5 is set to the top of case 1, the distance between contact portion 14 with trip piece 13 of trip device 5 and fulcrum 11 decreases and thereby, the trip load of trip device 5 must be increased.

Therefore, trip device 5 must bear more load. However, because the present invention uses top-end-swinging type trigger plate 7, the distance between the contact portion 14 with trip piece 13 of trip device 5 and fulcrum 11 increases and it is possible to decrease the trip load of trip device 5. Therefore, trip device 5 can be downsized. These advantages make it possible to compactly store units for leak in the conventional molded-type circuit breaker size specified in JIS C 8370 annex 5.

Advantages of the Invention

As described above, an earth leakage breaker of the present invention can be decreased in size. Moreover, the breaker has the advantages that a trip device constituted by adjacently arranging a test button and a leak trip solenoid can be set to the top of a case, thereby, assembling can be simplified, a bimetal adjusting screw can easily be manipulated from the outside, and the trip load of the trip device can be decreased. Therefore, the earth leakage breaker of the present invention is valuable as an earth leakage breaker solving conventional problems.

What is claimed:

1. An earth leakage breaker comprising:

a case;

a handle protruding from said case;

a cradle for determining stable positions of the handle;

a movable finger including a movable contact at a bottom portion of said movable finger, said movable finger being pivotally jointed to said handle at a protrusion provided on a lower side of said handle for pivotal movement of said movable finger relative to said handle during circuit breaking;

an extension spring spanning between said cradle and said movable finger;

a top-end swinging trigger plate for engaging said cradle, said trigger plate having a fulcrum at a bottom portion of said trigger plate;

a test button and a leak trip solenoid adjacently arranged at a top portion of said case, said leak trip solenoid having a trip piece engaged with a contact portion formed on a top portion of said trigger plate for effecting circuit breaking due to a leak.

2. The earth leakage breaker according to claim 1, wherein said extension spring spans between an upper portion of said cradle and a central portion of said movable finger.

3. The earth leakage breaker according to claim 1, wherein said trigger plate engages a right end of said cradle.

4. The earth leakage breaker according to claim 1, further comprising an adjusting screw for adjusting a position of an over-current detecting bimetal for effecting circuit breaking due to an over-current, said adjusting screw being set to a bottom portion of said case.

5. The earth leakage breaker according to claim 4, wherein said bimetal is vertically arranged in said case.

* * * * *